US006951191B1

(12) United States Patent
Lin

(10) Patent No.: US 6,951,191 B1
(45) Date of Patent: Oct. 4, 2005

(54) WATER HEATER PROVIDED WITH COMPACT DESIGN AND HOT WATER TEMPERATURE FOR HUMAN BODY

(76) Inventor: Guan-Chou Lin, 11F.-1, No. 23, Lane 98, Gongye 1st Rd., Situn Dist., Taichung City (TW)

( * ) Notice: Subject to any disclaimer, the term of this patent is extended or adjusted under 35 U.S.C. 154(b) by 34 days.

(21) Appl. No.: 10/753,272

(22) Filed: Jan. 9, 2004

(51) Int. Cl.[7] ..... E01C 19/45
(52) U.S. Cl. ..... 122/13.01; 122/DIG. 10; 126/367.1; 126/344
(58) Field of Search ..... 122/13.01, DIG. 10, 122/18.5, 30, 36, 37; 126/344, 350.1, 367.1, 126/377.1

(56) References Cited

U.S. PATENT DOCUMENTS 2,699,155 A * 1/1955 Olson et al. ..... 122/274
2,906,258 A * 9/1959 Parker ..... 122/250 R
3,681,567 A * 8/1972 Boecher ..... 392/358
4,751,897 A * 6/1988 Malhere et al. ..... 126/350.1
4,785,792 A * 11/1988 Saint Laurent ..... 126/344
5,415,133 A * 5/1995 Noh ..... 122/13.01
5,419,308 A * 5/1995 Lee ..... 122/14.21

* cited by examiner

*Primary Examiner*—Gregory Wilson
(74) *Attorney, Agent, or Firm*—Harrison & Egbert

(57) ABSTRACT

A water heater includes an exhaust hood, a heat exchange module, a main heat valve and a control valve extending downwardly in turn between a case and a plate. Inlet and outlet heads are installed on the two sides at the end of the hot water pipes respectively. Holes are punched on the case and the plate correspondingly to connect intake heads with water supply pipes going through the plate. The outlet head goes through the case and the pin connects with one water-intake hose directly. The control valve has one gas valve, one control switch and one water plate. The gas inlet of gas valve is connected with a gas can. Two pipes are installed on the water plate, which are pin connected with the intake head of the heat exchange module. With low flow capacity, the temperature of hot water output can be adjusted for direct use by a human body without mixing cold water.

6 Claims, 7 Drawing Sheets

WATER HEATER PROVIDED WITH COMPACT DESIGN AND HOT WATER TEMPERATURE FOR HUMAN BODY

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a water heater, and more particularly to a water heater which conveys hot water temperature suitable for a human body without mixing cold water in a more compact and convenient design.

BACKGROUND OF THE INVENTION

Although Taiwan is located in the subtropical area, Taiwanese are used to taking a bath with hot water no matter whether it is in hot summer or in cold winter so as to stimulate blood circulation, combat fatigue and relax their body and soul. Thus, it can be seen that water heaters become a necessity in people's daily lives. As a matter of fact, as for those people living in low-latitude area, the temperature of hot water used in bathing need not reach the standard of that in the warm and cold areas. Therefore, the Taiwanese household water heater obviously fails to bring its functions into full play. In addition, most water heaters are designed with both cold and hot water taps so the temperature of flowing water can be adjusted to suit the body requirement by means of mixing hot water generated from the water heater with cold water. It apparently increases water flow capacity but in fact causes excessive unnecessary energy waste by providing overheated water, and water resource waste by mixing overheated water. In another point, as for those who are fond of camping on mountains, it is always hard to take a hot water bath in wildness because firstly it is difficult to search water resources; secondly it is difficult to heat water; and thirdly it is easy to cause fire. Campers have to rely on camping trailers if they want to take a hot water bath, but the imported camping trailer costs several millions of dollars, which cannot be afforded by the average people. If campers want to bring household water heater by vehicle, it is required to bring the bulky and heavy gas can together. It takes time and energy to both disassemble and transport them. The journey may therefore lose its meaning and it is not feasible to travel in this way.

As mentioned above, in the present water heater market, it is lacking water heaters that are energy-saving and convenient to be brought for camping. In order to meet the demand of customers and solve the problem of inconvenient usage, this new-style multi-functional water heater, which is compact easy to be brought and low in flow capacity, is invented. It is an economic water heater with comfortable hot water, the temperature of which is suitable for a human body without mixing cold water.

BRIEF SUMMARY OF THE INVENTION

This water heater 10 is designed for compact size with use of portable gas can 90 so the water heater 10 is convenient to be brought outdoors to provide hot water with low flow capacity. The temperature of hot water output can be adjusted for direct use of human body without mixing cold water. The outlet head 44 goes through the case 21 and is pin connected directly with a water-intake hose 80 for direct shower so as to reduce consumption of hot water in overlong water-intake hoses. Moreover, due to the considerable flexibility of hot water pipes 42 of heat exchange module 40 and inlet 631 and outlet pipes 632 on the water plate 63, they can be folded to any side of the water heater in installation and meet the function of quick installation with water supply pipes to reduce installing and assembling time. It is therefore an economic water heater.

DETAILED DESCRIPTION OF THE INVENTION

The features and the advantages of the present invention will be more readily understood upon a thoughtful deliberation of the following detailed description of a preferred embodiment of the present invention with reference to the accompanying drawings.

Figure 1:
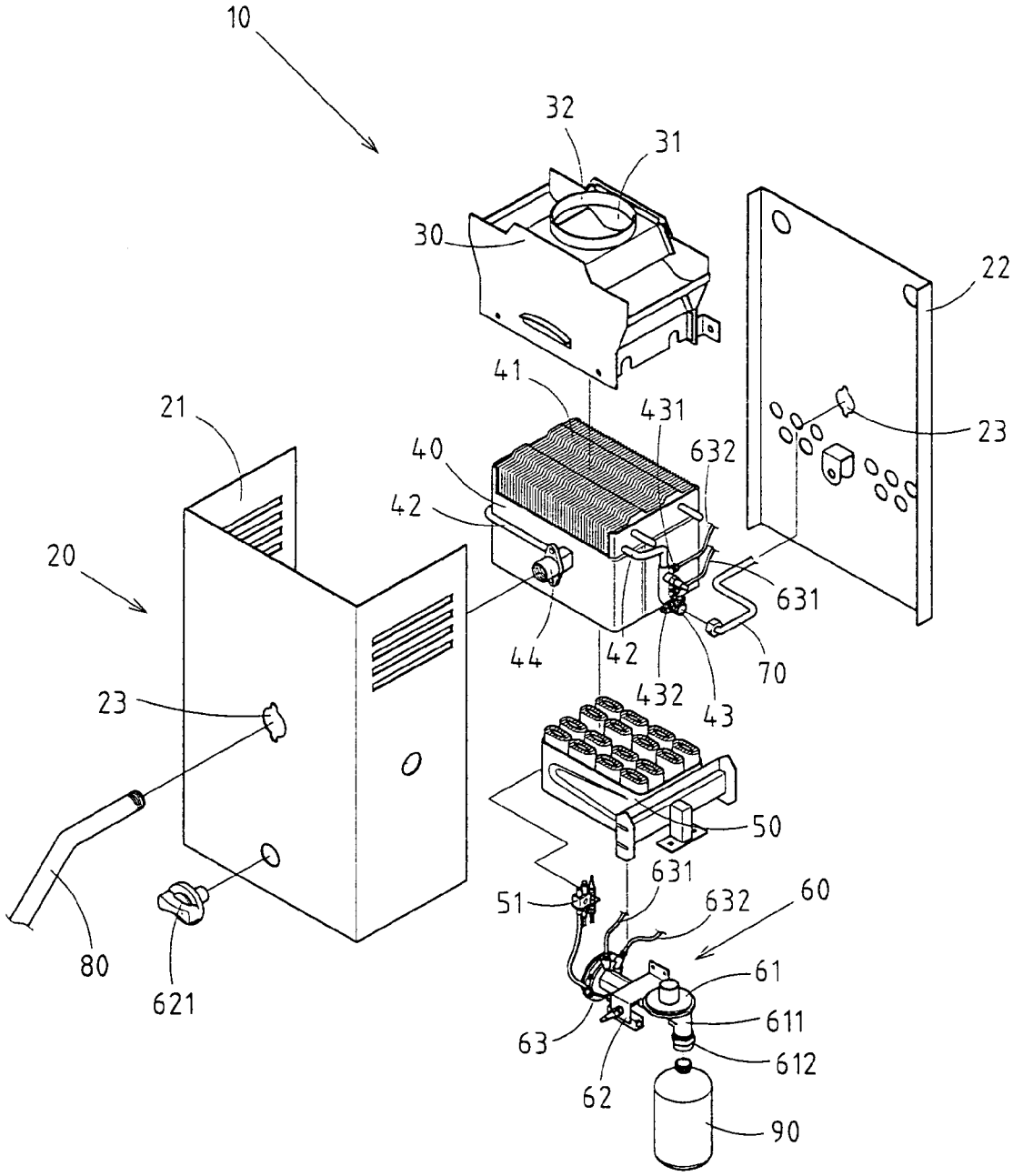
FIG. 1 shows a perspective view of the preferred embodiment of the present invention.
Figure 2:
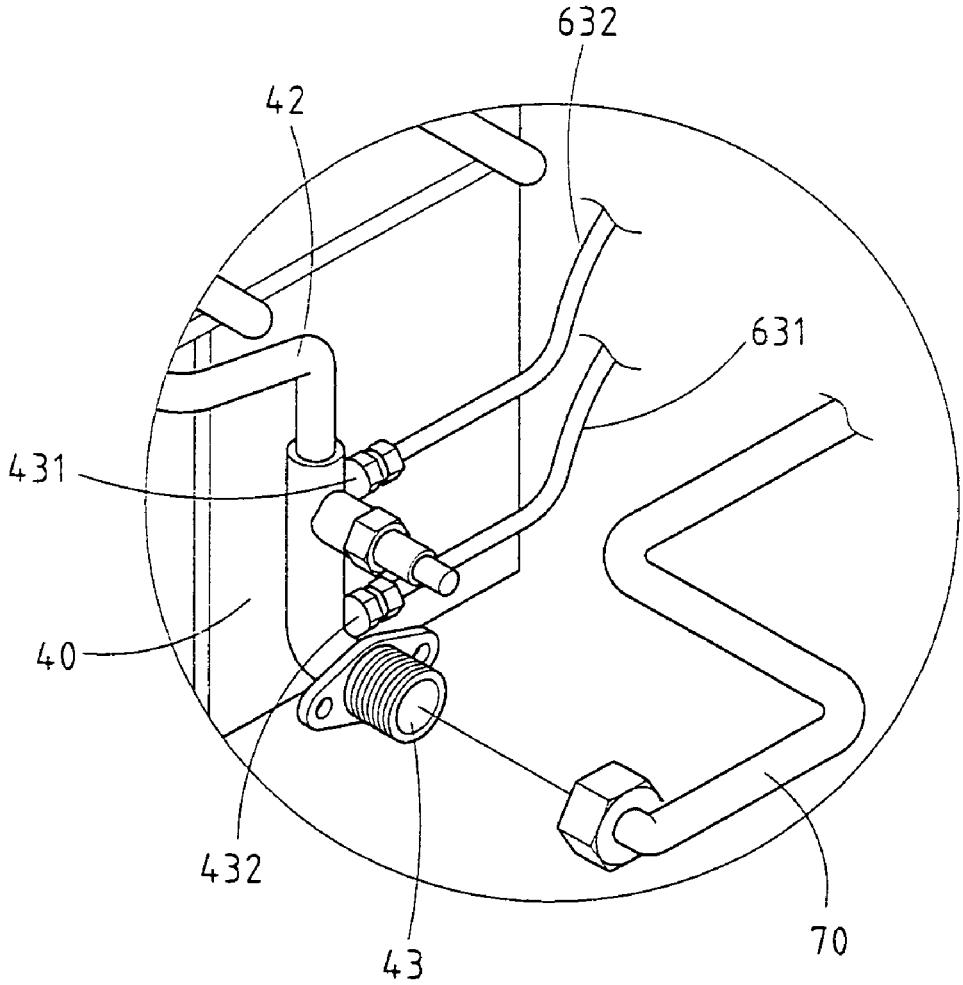
FIG. 2 shows an exploded perspective view of the heat exchanger of the invention.
Figure 3:
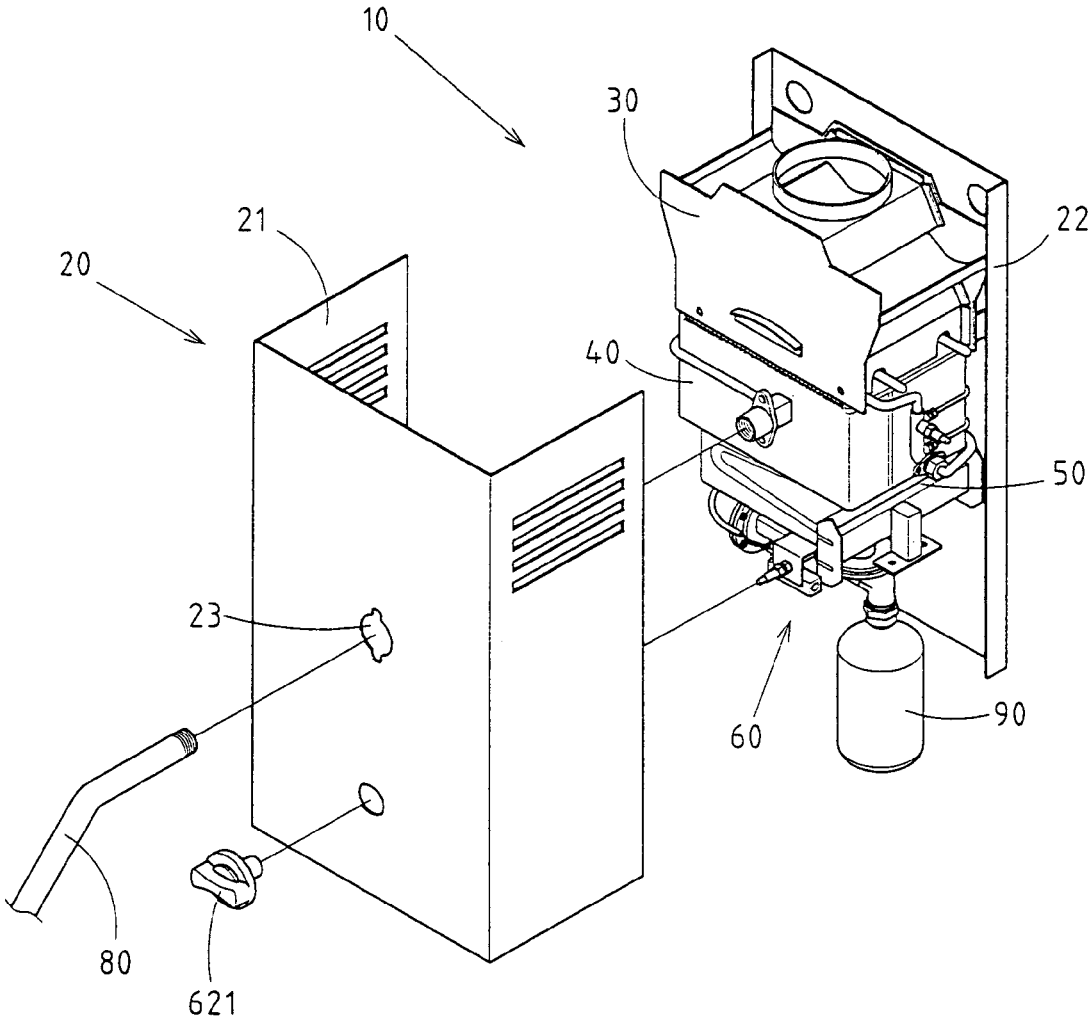
FIG. 3 shows a perspective view of the installed invention.

As shown in FIGS. 1–3, a water heater 10 embodies the present invention.

The invention includes a case 20 provided with one rectangular front case 21 and one back plate 22. The following fittings are installed inside after the front case and the back plate have been assembled.

The invention also has an exhaust hood 30 installed inside the case 20 and near the coping with one vent 31 on the top. The vent 31 with flange is a pipe equipped for exhaust gas.

There is also a heat exchange module 40 and one main heat valve 50 installed under the exhaust hood 30, on which are installed with several heat sinks 41 and twist hot water pipes 42. The hot water pipes have considerable flexibility, and the inlet head 43 and the outlet head 44 are installed at the end of the back and the front respectively. Holes 23 are punched on the case 21 and the plate 22 correspondingly to connect intake head 43 with water supply pipes 70 going through the plate 22. The outlet head 44 goes through the case 21 and pin connects with one water-intake hose 80 directly. The ignition module 51 is installed on one side of main heat valve 50.

The invention further includes a control valve 60 installed under the main heat valve 50 such that the control valve 60 consists of a gas valve 61, a control switch 62 and a water plate 63. The gas inlet 611 of gas valve 61 is equipped with a connector and connected with a portable gas can 90. The control switch and the ignition module of the main heat valve are equipped with connecting lines to control ignition. The front of control switch 62 is out of the case and equipped with an adjusting button 621 as a switch. Two inlet pipes 631 and outlet pipes 632 are installed on the water plate 63, which are pin connected with the input terminal 431 and output terminal 432 of the intake head 43 of the heat exchange module. These two inlet pipes 631 and outlet pipes 632 are with considerable flexibility.

The embodiment of the present invention described above is designed in compact size with use of portable gas can 90. It is convenient to be brought outdoors to provide hot water with low flow capacity. The temperature of hot water output can be adjusted for direct use by a human body without mixing cold water. The outlet head 44 goes through the case 21 and is pin connected directly with a water-intake hose 80 for direct shower so as to reduce consumption of hot water in overlong water-intake hoses. Moreover, due to the considerable flexibility of hot water pipes 42 of heat exchange module 40 and inlet 631 and outlet pipes 632 on the water plate 63, they can be folded to any side of the water heater in installation and meet the function of quick installation with water supply pipes to reduce installing and assembling time. It is therefore an economic water heater.

FIG. 2 shows the structure of the intake head 43 in the heat exchange module 40 is based on Venturi meter theory. There is a pressure drop of flowing water between the outlet head 43 and the input 431 and output terminals 432, so as to easily control the gas valve and the ignition module of main heat valve. Especially when the water pressure is low, it can adjust inner flow to increase pressure drop of the input 431 and output terminals 432.

Figure 4:
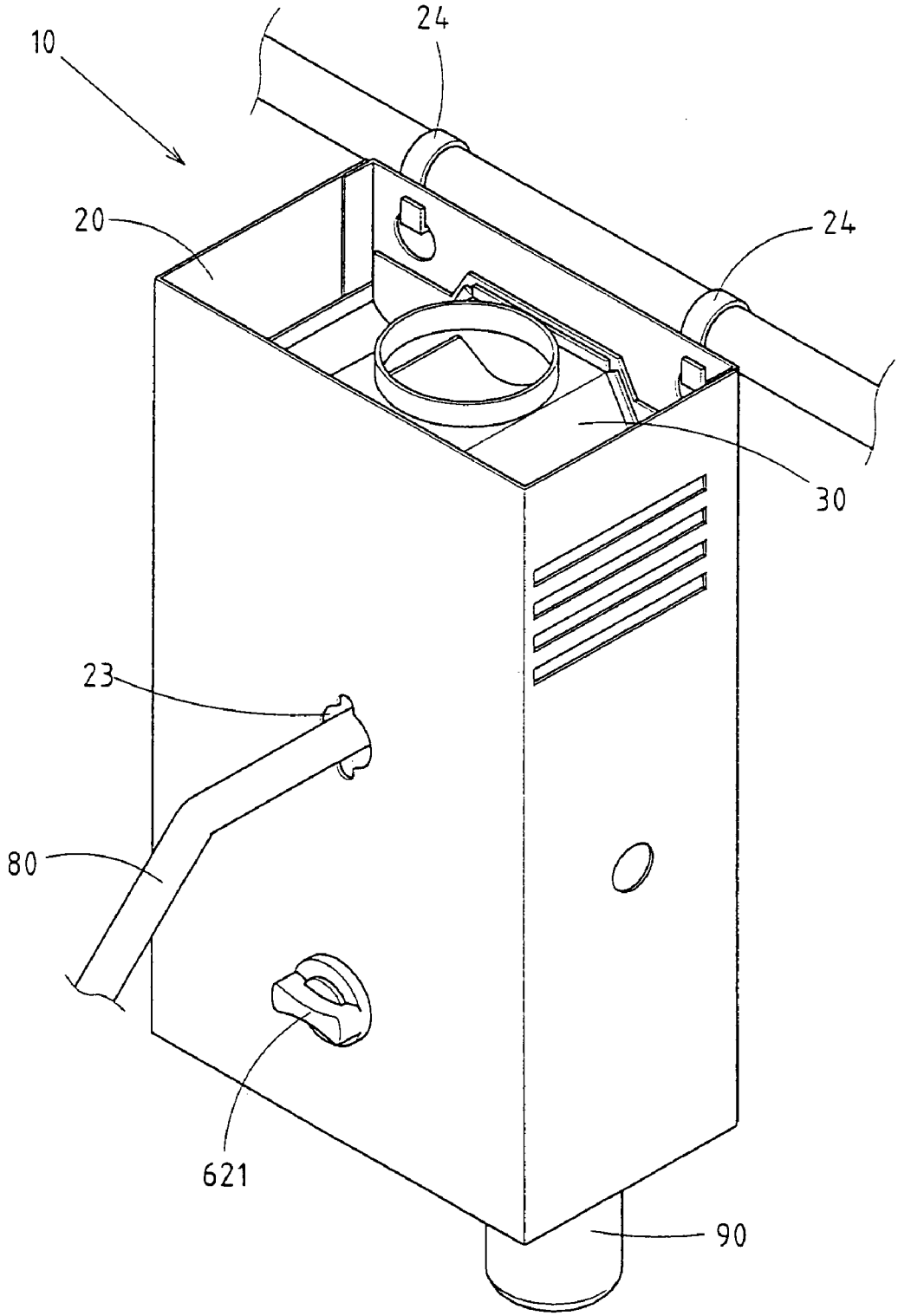
FIG. 4 shows a perspective view of the suspending state of the present invention.

FIG. 4 shows the several suspension components 24 on one side of the water heater 10 so as to suspend the water heater 10 in a proper place.

Figure 5:
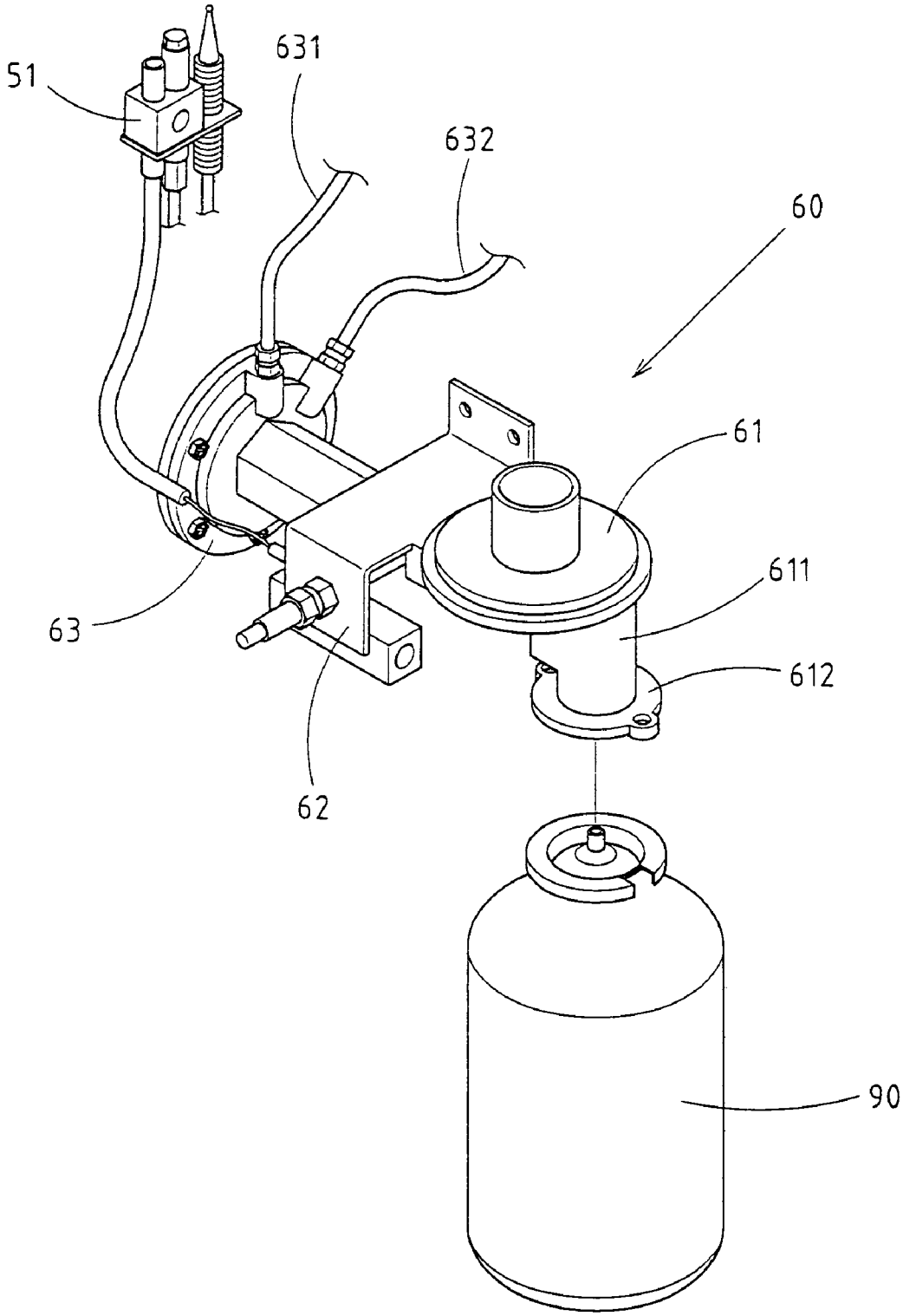
FIG. 5 shows a perspective view of the gas valve connector of the present invention.

FIG. 5 shows the gas inlet 611 of the gas valve 61 can be changed into another type of connector 612 to pin connect another type of portable gas can 90.

Figure 6:
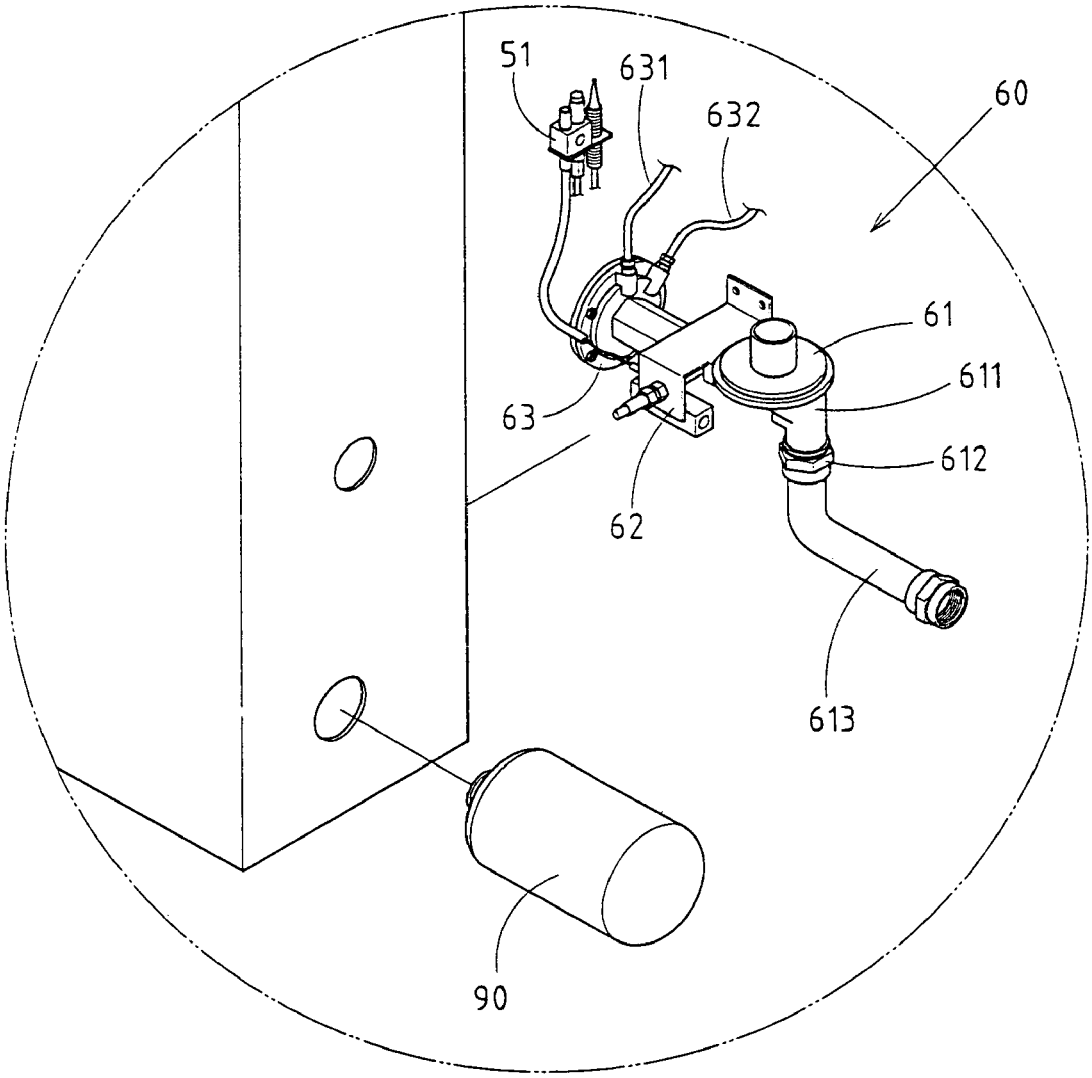
FIG. 6 shows a perspective view of the gas inlet of gas valve of the present invention.
Figure 7:
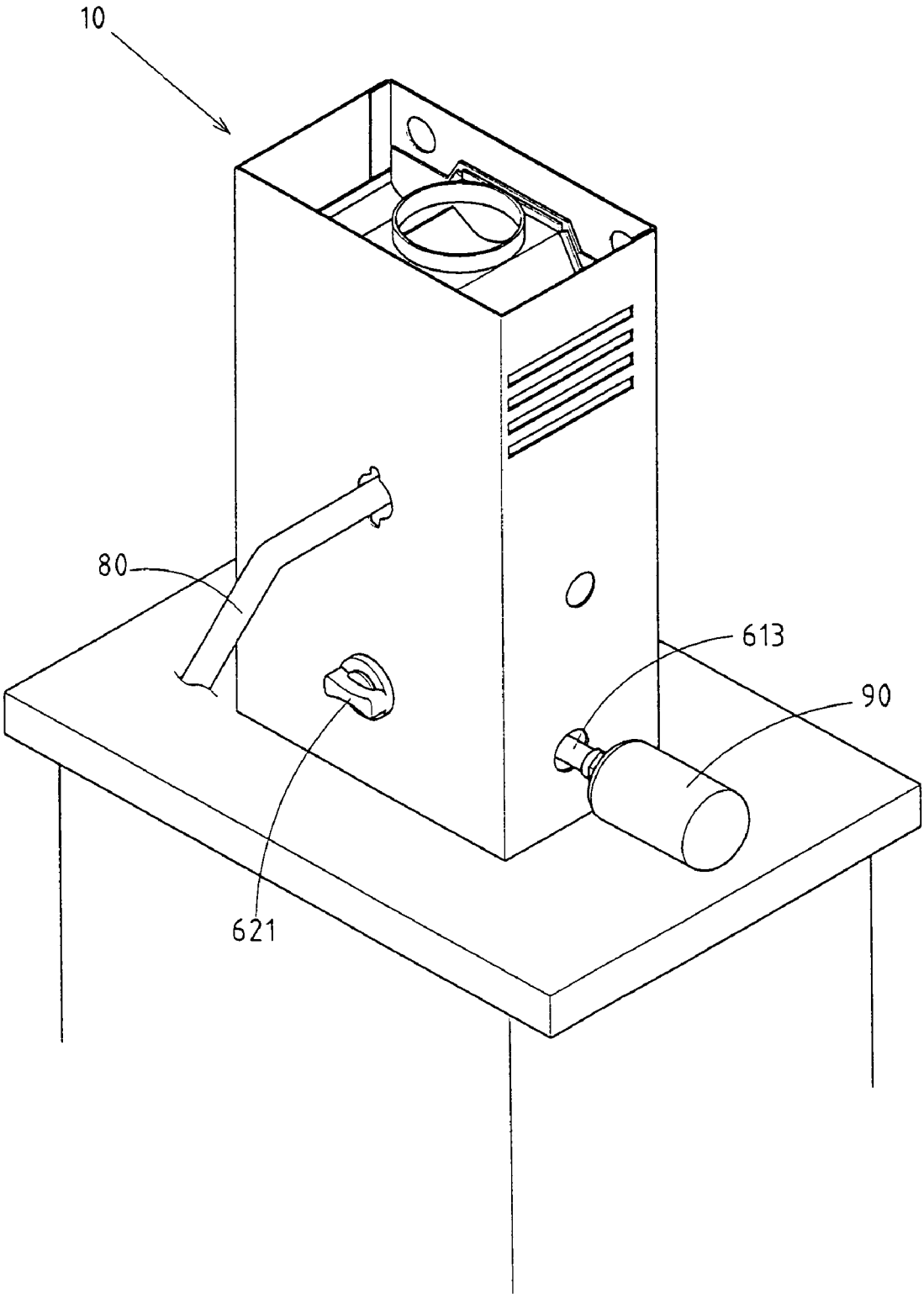
FIG. 7 shows a perspective view of the vertical state of the present invention.

FIG. 6 shows the gas inlet 611 of the gas valve 61 can be firstly installed with an L-shape rotational pipe 613, and then pin connected with the connector 612 and gas can 90 so as to connect the gas can 90 and the water heater 10 in any suitable place on the side of the water heater 10. When the gas can is pin connected on the side of water heater 10, the water heater 10 can be positioned upright (as shown in FIG. 7).

I claim:

1. A water heater comprising:

a case comprised of one front case and one back plate and fittings inside an interior thereof;

a exhaust hood installed inside the case and near the coping with one vent on the top;

a heat exchange module and a main heat valve installed under the exhaust hood, said heat exchange module having an inlet head and outlet head installed on two sides at an end of hot water pipes respectively; wherein holes are punched on the case and the plate correspondingly to connect intake head with water supply pipes going through the plate; wherein the outlet head goes through the case and a pin connects one water-intake hose directly said water pipes having considerable flexibility; and wherein the ignition module is installed on one side of main heat valve;

a control valve installed under the main heat valve, said control valve being comprised of one gas valve, one control switch and one water plate; wherein a gas inlet of said gas valve is connected to a gas can; wherein pipes are installed on the water plate, which are pin connected with the input terminal and output terminal of the heat exchange module, said two pipes having considerable flexibility;

wherein low flow capacity the temperature of hot water output adjusts for direct use by a human body without mixing cold water.

2. The water heater defined in claim 1, wherein said inlet head and outlet head of the water heater can be installed in any suitable place on the side of the water heater.

3. The water heater defined in claim 1, wherein said intake head in the heat exchange module is constructed on the basis of Venturi meter theory, such that a pressure drop of flowing water between the outlet head and the input and output terminals controls the gas valve and the ignition module of main heat valve; wherein, when the water pressure is low, inner flow is adjusted to increase pressure drop of the input and output terminals.

4. The water heater defined in claim 1, wherein said suspension components are located on one side of the water heater, so as to suspend the water heater in a proper place.

5. The water heater defined in claim 1, wherein said gas inlet of the gas valve and gas are further comprised of a connector at a connecting point.

6. The water heater defined in claim 1, wherein said gas inlet of the gas valve can be firstly installed with a rotational pipe, and then pin connected with the connector and gas can, so as to connect the gas can with the water heater in any suitable place on the side of the water heater.

* * * * *